US008376173B2

(12) United States Patent
Britto et al.

(10) Patent No.: US 8,376,173 B2
(45) Date of Patent: Feb. 19, 2013

(54) DRINKING CONTAINER WITH STRAW

(75) Inventors: James J. Britto, Westport, MA (US); John J. Krammes, Chelmsford, MA (US); Mary O'Brien, Hull, MA (US); Jen Gomes, Norton, MA (US)

(73) Assignee: Learning Curve Brands, Inc., Dyersville, IA (US)

( * ) Notice: Subject to any disclaimer, the term of this patent is extended or adjusted under 35 U.S.C. 154(b) by 593 days.

(21) Appl. No.: 12/596,355

(22) PCT Filed: Apr. 23, 2008

(86) PCT No.: PCT/US2008/061327

§ 371 (c)(1),
(2), (4) Date: Oct. 16, 2009

(87) PCT Pub. No.: WO2008/131437

PCT Pub. Date: Oct. 30, 2008

(65) Prior Publication Data

US 2010/0170902 A1 Jul. 8, 2010

Related U.S. Application Data

(60) Provisional application No. 60/913,464, filed on Apr. 23, 2007.

(51) Int. Cl.
*B65D 51/18* (2006.01)

(52) U.S. Cl. ..... 220/254.3; 220/707; 220/708; 220/709; 215/229; 215/388; 206/217

(58) Field of Classification Search ..... 220/367.1, 220/711, 709, 245.3, 705, 706, 707, 708; 215/229, 388; 206/217
See application file for complete search history.

(56) References Cited

U.S. PATENT DOCUMENTS

| | | | |
|---|---|---|---|
| 5,188,283 | A | 2/1993 | Gu |
| 5,273,172 | A | 12/1993 | Rossbach et al. |
| 5,337,918 | A | 8/1994 | Wang |
| 5,339,982 | A | 8/1994 | Tardie |
| 5,346,081 | A | 9/1994 | Lin |
| 5,361,934 | A | 11/1994 | Spence, Jr. |
| 5,484,080 | A | 1/1996 | Blasnik et al. |
| 5,518,142 | A | 5/1996 | Lin |
| 5,520,304 | A | 5/1996 | Lin |
| 5,579,948 | A | 12/1996 | Lin |
| 5,582,320 | A | 12/1996 | Lin |

(Continued)

FOREIGN PATENT DOCUMENTS

| | | |
|---|---|---|
| JP | 2002326655 | 11/2002 |
| JP | 2003205958 | 7/2003 |

(Continued)

OTHER PUBLICATIONS

PCT/US2008/061327 International Search Report and Written Opinion dated Sep. 30, 2008 (8 pages).

*Primary Examiner* — Mickey Yu
*Assistant Examiner* — Kareen Rush
(74) *Attorney, Agent, or Firm* — Michael Best & Friedrich LLP

(57) ABSTRACT

A drinking container including a main body and a removable lid. The lid includes an opening configured to receive a straw. The lid includes a removable cover having an opening configured to receive an upper portion of the straw. The cover includes a slide mechanism adapted to move and bend the straw to close the opening. The straw is bent at an angle to prevent closing or kinking of the straw.

20 Claims, 7 Drawing Sheets

U.S. PATENT DOCUMENTS

| | | | | |
|---|---|---|---|---|
| 5,651,471 | A * | 7/1997 | Green | 220/231 |
| 5,709,478 | A * | 1/1998 | Chen | 383/80 |
| 5,897,013 | A | 4/1999 | Manganiello | |
| 5,908,126 | A | 6/1999 | Wang | |
| 6,050,433 | A | 4/2000 | Russell et al. | |
| 6,116,458 | A | 9/2000 | Dark | |
| 6,276,560 | B1 | 8/2001 | Belcastro | |
| 6,279,773 | B1 | 8/2001 | Kiyota | |
| 6,296,140 | B1 | 10/2001 | Prieto | |
| 6,390,341 | B1 | 5/2002 | Ohmi et al. | |
| 6,431,434 | B1 * | 8/2002 | Haughton et al. | 229/103.1 |
| 6,491,184 | B2 | 12/2002 | Prieto | |
| 6,523,711 | B1 | 2/2003 | Hughes et al. | |
| 6,609,624 | B2 | 8/2003 | Goto et al. | |
| 6,619,518 | B1 | 9/2003 | Lee | |
| 6,840,397 | B1 | 1/2005 | Rosenberg | |
| 6,991,126 | B2 | 1/2006 | Jackel | |
| 7,093,735 | B2 * | 8/2006 | Stephens | 220/705 |
| 7,097,065 | B2 | 8/2006 | Yoneoka et al. | |
| 7,124,907 | B2 | 10/2006 | Conaway | |
| 7,516,862 | B2 | 4/2009 | McDonough | |
| 2005/0029271 | A1 | 2/2005 | McDonough | |
| 2005/0115967 | A1 * | 6/2005 | Conaway | 220/254.1 |
| 2006/0186076 | A1 * | 8/2006 | Shiloni | 215/229 |
| 2008/0217285 | A1 * | 9/2008 | Roth et al. | 215/229 |

FOREIGN PATENT DOCUMENTS

| | | |
|---|---|---|
| KR | 100659600 | 12/2006 |

* cited by examiner

DRINKING CONTAINER WITH STRAW

RELATED APPLICATION

This application claims the benefit of U.S. Provisional Patent Application Ser. No. 60/913,464 filed on Apr. 23, 2007, the contents of which are hereby incorporated by reference.

BACKGROUND

Children's drinking cups are generally provided with removable lids, to help prevent large spills. Commonly, these lids have drinking spouts extending from their upper surface, that children place in their mouths to sip from the cups. Such cups are sometimes called "sippy cups."

SUMMARY

As children grow, they are introduced to drinking containers having a straw.

In one aspect, the invention provides a drinking container comprising a main body defining an interior cavity accessible through an opening at an upper end of the main body, the main body having a rim about the opening and a removable lid secured to the rim of the main body to enclose the interior cavity. The removable lid includes an outer wall, an inner support structure supported by the outer wall. The inner support structure includes a first wall, a member extending from the first wall, a protrusion including a second wall positioned opposite the first wall, the second wall having a first portion substantially parallel with respect to the first wall and a curved portion extending upward from the first portion, and an opening between the member and the second wall. The drinking container also includes a straw positioned in the opening and coupled to the inner support structure, the straw having a lower portion extending into the interior cavity of the main body and an upper portion extending through the opening and a removable cover coupled to the removable lid, the cover including an opening configured to receive the upper portion of the straw and a slide mechanism configured to slide within the opening of the cover and bend the upper portion of the straw along the curved portion of the second wall and enclose the upper portion of the straw within the cover.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

Although directional references, such as upper, lower, downward, upward, rearward, bottom, front, rear, etc., may be made herein in describing the drawings, these references are made relative to the drawings (as normally viewed) for convenience. These directions are not intended to be taken literally or limit the present invention in any form. In addition, terms such as "first," "second," and "third" are used herein for purposes of description and are not intended to indicate or imply relative importance or significance.

Figure 1:
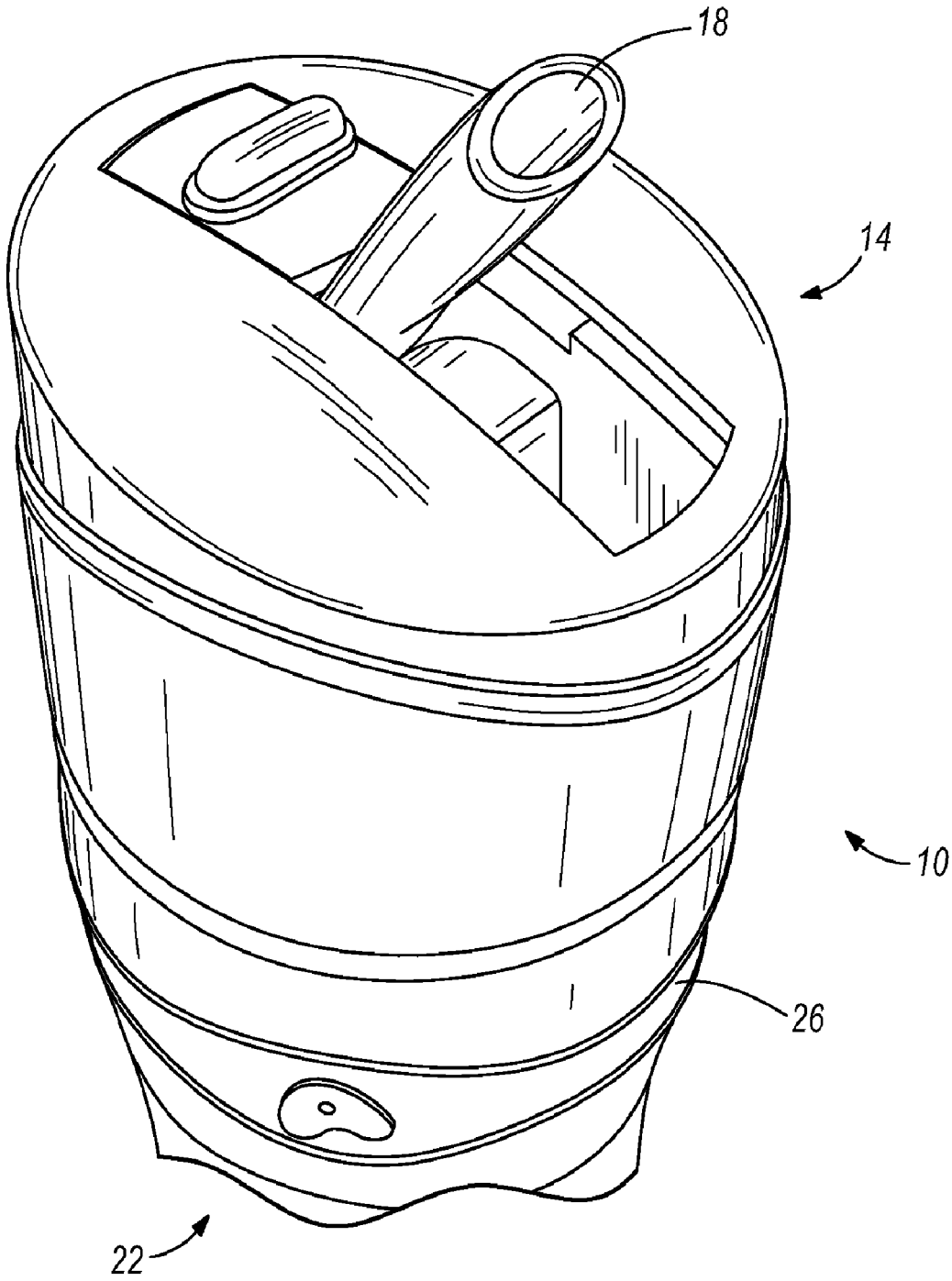
FIG. 1 is a perspective view of a drinking container according to one embodiment of the present invention.
Figure 2:
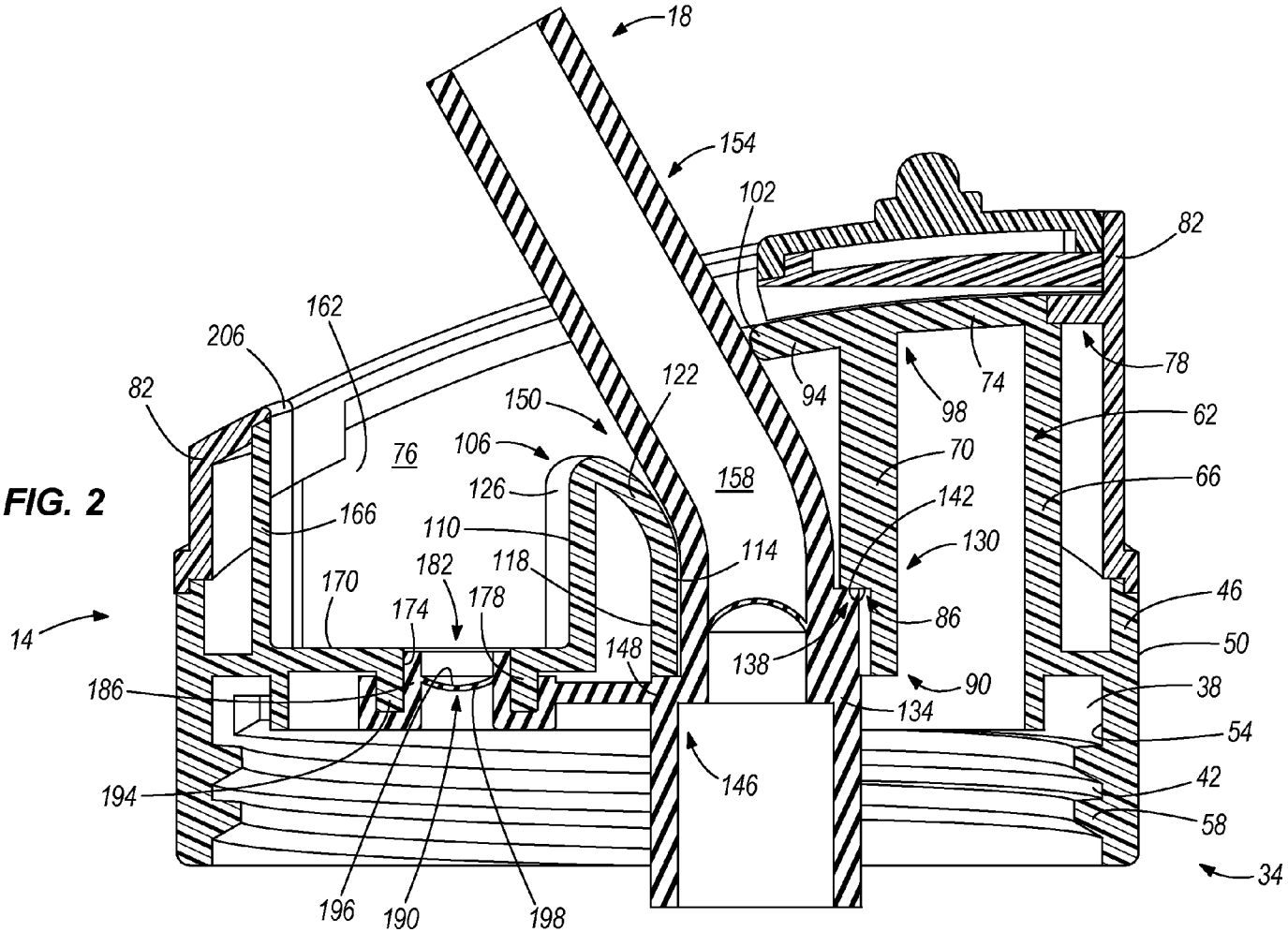
FIG. 2 is a side cross-sectional view of the drinking container illustrated in FIG. 1.
Figure 3:
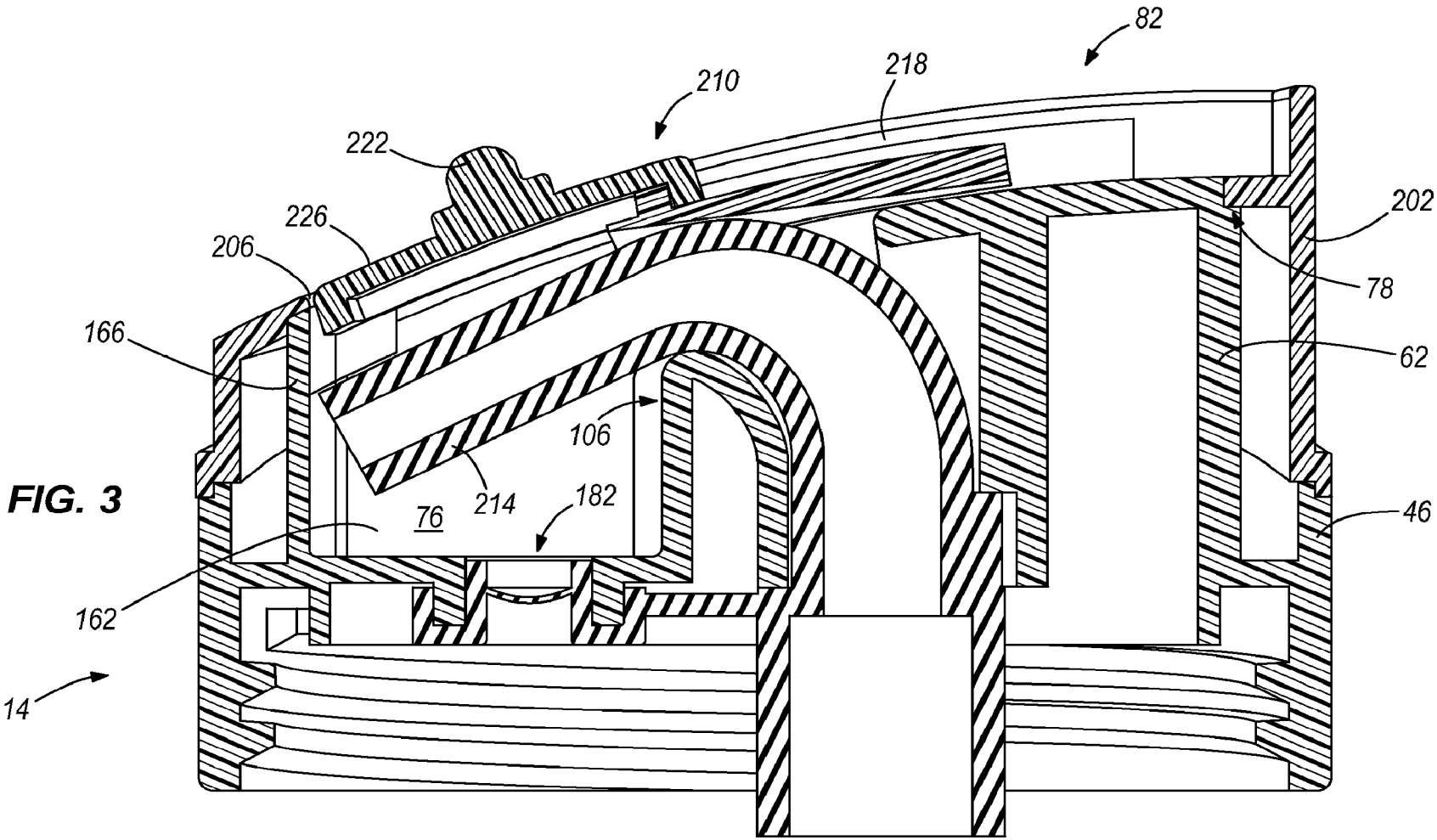
FIG. 3 is a side cross-sectional view of the drinking container illustrated in FIG. 1.
Figure 4:
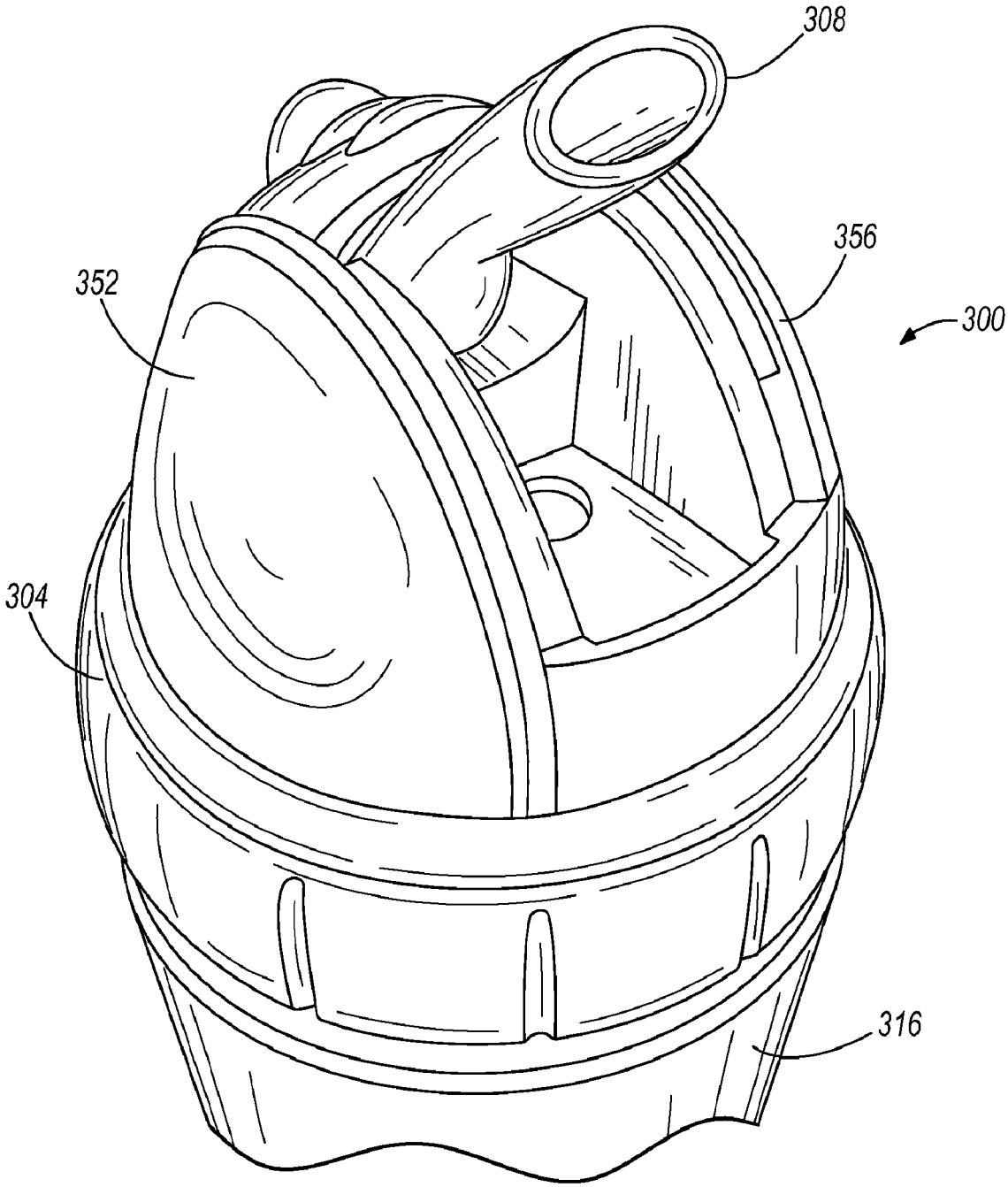
FIG. 4 is a perspective view of a drinking container according to another embodiment of the present invention.
Figure 5:
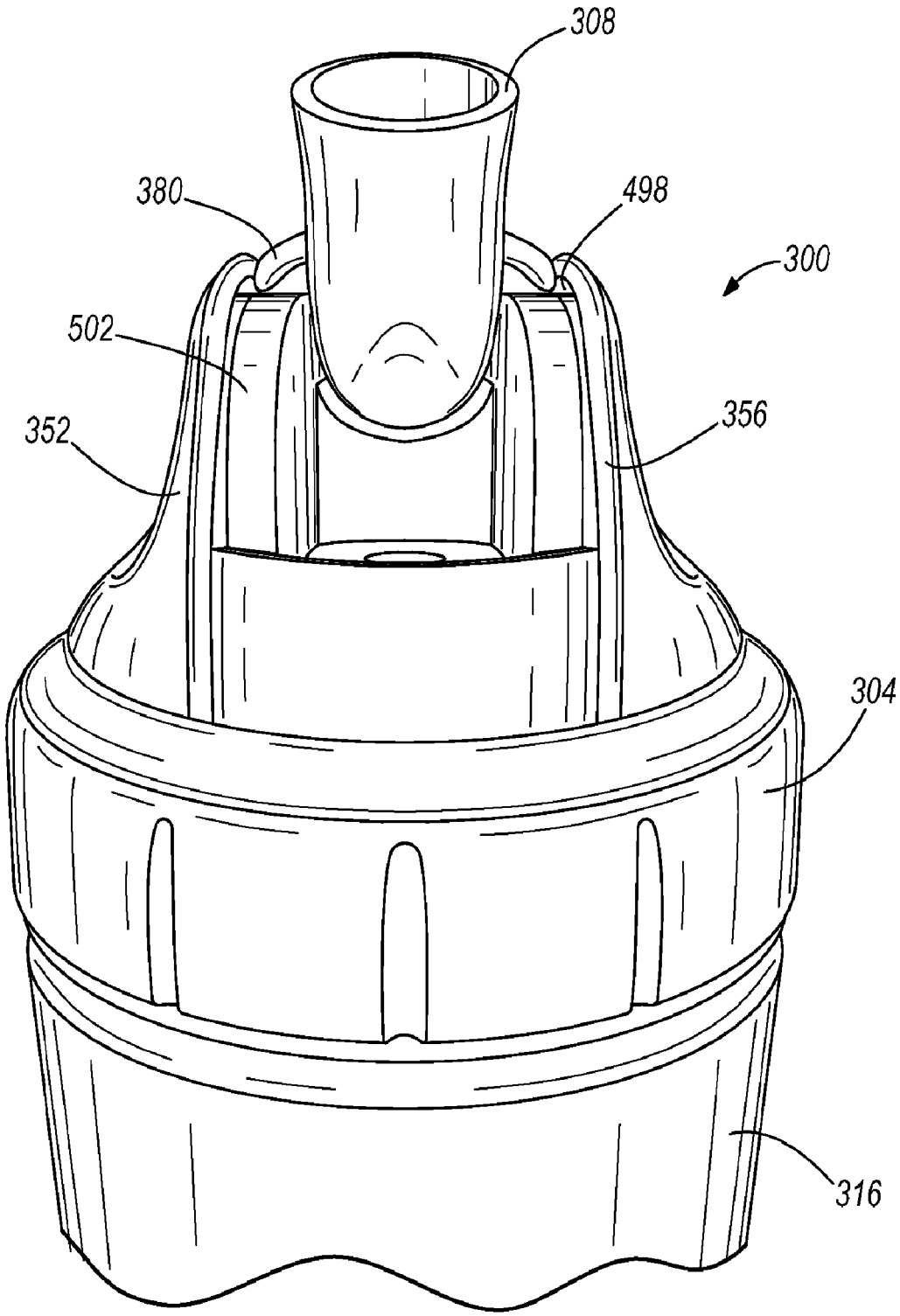
FIG. 5 is a front perspective view of the drinking container illustrated in FIG. 4.

FIGS. 1-3 illustrate a drinking container 10 having a lid 14 and a fluid conduit 18, such as a straw, according to one embodiment of the present invention. The container 10 includes a bottom wall 22 and a side wall 26 extending upward from the bottom wall 22 that define an interior 30. The container 10, as illustrated in the FIGS. 1-3, is generally circular shaped, but could also include other suitable shapes, such as oval, square, rectangular, or irregular shapes. The side wall 26 includes an upper portion 34 adapted to receive the lid 14. The upper portion 34 includes a rim 38 and threads 42 for engaging complementary threads on the lid 14.

The container 10 can be molded from a suitable polypropylene material having a suitable thickness and durability. Other suitable materials and/or combinations of materials may also be used to manufacture the container 10. The lid 14 also can be molded from a suitable polypropylene material having a suitable thickness, but is not limited to polypropylene material.

The lid 14 includes an outer wall 46 having an outer surface 50 and an inner surface 54. The inner surface 54 includes threads 58 adapted to engage the threads 42 on the container 10 as mentioned above. The inner surface 54 is coupled to an inner support structure 62 adapted to support the straw 18. The support structure 62 includes a first wall 66 connected to the inner surface 54, a second wall 70 oriented generally parallel to the first wall 66, and a third wall 74 connected to the first wall 66 and the second wall 70. The support structure 62 also includes two side walls 76 oriented generally perpendicular to the first wall 66, the second wall 70, and the third wall 74.

The first wall 66 includes a notch 78 adapted to receive a portion of a cover 82 (discussed below) at a location where the first wall 66 and the third wall 74 generally intersect. The second wall 70 includes a notch 86 at a first end 90 adapted to receive a portion of the straw 18. The third wall 74 includes a member 94 extending beyond the intersection of a second end 98 of the second wall 70 and the third wall 74. The member 94 includes a distal end 102 having a contoured or rounded shape.

The inner support structure 62 also includes a protrusion 106 having a first wall 110 and a second wall 114 connected to the first wall 110. The second wall 114 includes a first relatively vertical portion 118 that is oriented parallel with the first wall 110 and a second curved portion 122 extending upward from the vertical portion 118 until connecting with a distal end 126 of the first wall 110. The intersection of the first wall 110 and the second wall 114 is rounded.

The inner support structure 62 also includes a first opening 130 into the interior 30 of the container 10. The first opening 130 is defined by the second wall 70 and the vertical portion 118 of the second wall 114 of the protrusion 106. The first opening 130 is adapted to support a lower portion 134 of the straw 18. The lower portion 134 of the straw 18 includes a first extension 138 adapted to engage a lower surface 142 of the notch 86. The lower portion 134 of the straw 18 also includes a second extension 146 at a vertical position lower than a position of the first extension 138. The second extension 146 is adapted to engage a lower surface 148 of the vertical portion 118 of the second wall 114 of the protrusion 106.

The inner support structure 62 also includes a second opening 150 adapted to receive an upper portion 154 of the straw 18. The second opening 150 is defined by the member 94 of the third wall 74 and the curved portion 122 of the second wall 114 of the protrusion 106. The second opening 150 is laterally offset and angularly displaced from the first opening 130. The upper portion 154 of the straw 18 is flexible and includes a bendable portion 158 such that the upper portion 154 can be oriented at an angle with respect to the lower portion 134 of the straw 18. The angle at which the upper portion 154 bends with respect to the lower portion 134 can be in the range of about zero degrees to about 60 degrees, and more particularly in the range of about zero degrees to about 35 degrees.

The inner support structure 62 also includes a recess 162 defined by a first wall 166, a bottom wall 170, the first wall 110 of the protrusion 106, and the two side walls 76. The height of the first wall 166 is greater than the height of the first wall 110. The bottom wall 170 includes an opening 174 having a lip 178 extending downward into the interior 30 of the container 10. The opening 174 is adapted to receive a vent 182, which includes a generally vertical wall 186 engaged with the opening 174 and a channel 194 that engages the lip 178. The vent 182 includes a membrane 190 having a concave outer surface 196 and a convex inner surface 198. The membrane 190 includes an opening adapted to allow air to enter the interior 30 of the container 10 when suction or a vacuum is applied to the straw 18. The membrane 190 is formed such that fluid does not leak from the container 10.

The lid 14 includes the cover 82 supported by the inner support structure 62. The cover 82 includes an outer wall 202 that engages the outer wall 46 of the lid 14 by a frictional fit such that the cover 82 can be removed from the inner support structure 62 for cleaning purposes. The cover 82 is also supported by the first wall 166 of the recess 162, the side walls 76, and the notch 78 in the first wall 66 of the support structure 62. The cover 82 includes an opening 206 that generally extends the length of the cover 82. The upper portion 154 of the straw 18 extends through this opening 206.

The cover 82 also includes a slide mechanism 210 generally rectangular-shaped and having a flange 214 on at least two of the parallel sides of the mechanism 210. The flanges 214 engage a track 218 formed along the respective parallel sides of the opening 206 in the cover 82. The slide mechanism 210 includes a knob 222 on a top surface 226 that allows the user to manipulate the slide mechanism 210 between an open position (as shown in FIG. 2) and a closed position (as shown in FIG. 3).

When the slide mechanism 210 is in an open position, the upper portion 154 of the straw 18 extends through the opening 206 in the cover 82 such that the user can drink from the straw 18. In the open position, the slide mechanism 210 generally rests upon or is supported by the third wall 74 of the inner support structure 62.

When the slide mechanism 210 is moved from the open position toward the closed position, the slide mechanism 210 contacts the upper portion 154 of the straw 18 to urge the upper portion 154 of the straw 18 into the recess 162. The upper portion 154 of the straw 18 bends around the curved portion 122 of the protrusion 106 until a distal end 214 of the straw 18 is positioned within the recess 162. While the slide mechanism 210 is closed, the upper portion 154 of the straw 18 is enclosed within the lid 14. The straw 18 does not close or restrict fluid flow therein (i.e., the straw 18 does not pinch or kink shut). If fluid leaks out the distal end 214 of the straw 18, the excess fluid will collect in the recess 162 and flow back into the interior 30 of the container 10 through the membrane 190 in the vent 182.

FIGS. 4-7 illustrate a drinking container 300 having a lid 304 and a fluid conduit 308, such as a straw, according to one embodiment of the present invention. The container 300 includes a bottom wall 312 and a side wall 316 extending upward from the bottom wall 312 that define an interior 320. The container 300, as illustrated in the figure is generally circular shaped, but could also include other suitable shapes, such as oval, square, rectangular, or irregular shapes. The side wall 316 includes an upper portion 324 adapted to receive the lid 304. The upper portion 324 includes a rim 328 and threads 332 for engaging complementary threads on the lid 304.

The container 300 can be molded from a suitable polypropylene material having a suitable thickness and durability. Other suitable materials and/or combinations of materials may also be used to manufacture the container 300. The lid 304 also can be molded from a suitable polypropylene material having a suitable thickness, but is not limited to polypropylene material.

The lid 304 includes an outer wall 336 having an outer surface 340 and an inner surface 344. The inner surface 344 includes threads 348 adapted to engage the threads 332 on the container 300 as mentioned above. The lid 304 also includes a first generally planar wall 352 and a second generally planar wall 356 oriented generally parallel with respect to the first planar wall 352. The planar walls 352 and 356 are integrally molded with the outer wall 336 of the lid 304. The planar walls 352 and 356 are hemispherical-shaped (or dome-shaped). The lid 304 includes a third wall 360 connected to a first portion 364 of the first wall 352 and a first portion 368 of the second wall 356. The third wall 360 includes a curved portion 372 and is connected to the outer wall 336 via a cavity 376 adapted to receive a portion of a cover 380 (discussed below). The third wall 360 includes a wall 384 extending downward from a peak 388 of the curved portion 372. The wall 384 includes a notch 392 at a first end 394 adapted to receive a portion of the straw 308.

The lid 304 also includes a protrusion 398 having a first wall 402 and a second wall 404 connected to the first wall 402. The second wall 404 includes a first relatively vertical portion 408 that is oriented parallel with the wall 384 and a second curved portion 412 extending upward from the vertical portion 408 until connecting with a distal end 416 of the first wall 402. The intersection of the first wall 402 and the second wall 404 is rounded.

The lid 304 also includes a first opening 420 into the interior 320 of the container 300. The first opening 420 is defined by the second wall 384 and the vertical portion 408 of the second wall 404 of the protrusion 398. The first opening 420 is adapted to support a lower portion 424 of the straw 408. The lower portion 424 of the straw 408 includes a first extension 428 adapted to engage a lower surface 432 of the vertical portion 408 of the second wall 404 of the protrusion 398. The lower portion 424 of the straw 408 also includes a second extension 436 at a vertical position higher than a position of the first extension 428. The second extension 436 is adapted to engage the notch 392 at the first end 394 of the wall 384.

The lid 304 also includes a second opening 440 adapted to receive an upper portion 444 of the straw 308. The second opening 440 is defined by an edge 448 of the cover 380 and the curved portion 412 of the second wall 404 of the protrusion 398. The second opening 440 is laterally offset and angularly displaced from the first opening 420. The upper portion 444 of the straw 308 is flexible and includes a bendable portion 452 such that the upper portion 444 can be oriented at an angle with respect to the lower portion 424 of the straw 308. The angle at which the upper portion 444 bends with respect to the lower portion 424 can be in the range of about zero degrees to about 90 degrees, and more particularly in the range of about zero degrees to about 75 degrees.

The lid 304 also includes a recess 456 defined by the outer wall 336, a bottom wall 462, the first wall 402 of the protrusion 398, and the two planar walls 352, 356. The height of the first wall 402 is greater than the height of the outer wall 336. The bottom wall 462 includes an opening 466 having a lip 470 extending downward into the interior 320 of the container 300. The opening 466 is adapted to receive a vent 474, which includes a generally vertical wall 478 engaged with the opening 466 and a channel 482 that engages the lip 470. The vent 474 includes a membrane 486 having a concave outer surface 490 and a convex inner surface 494. The membrane 486 includes an opening adapted to allow air to enter the interior 320 of the container 300 when suction or a vacuum is applied to the straw 308. The membrane 486 is formed such that fluid does not leak from the container 300.

Figure 6:
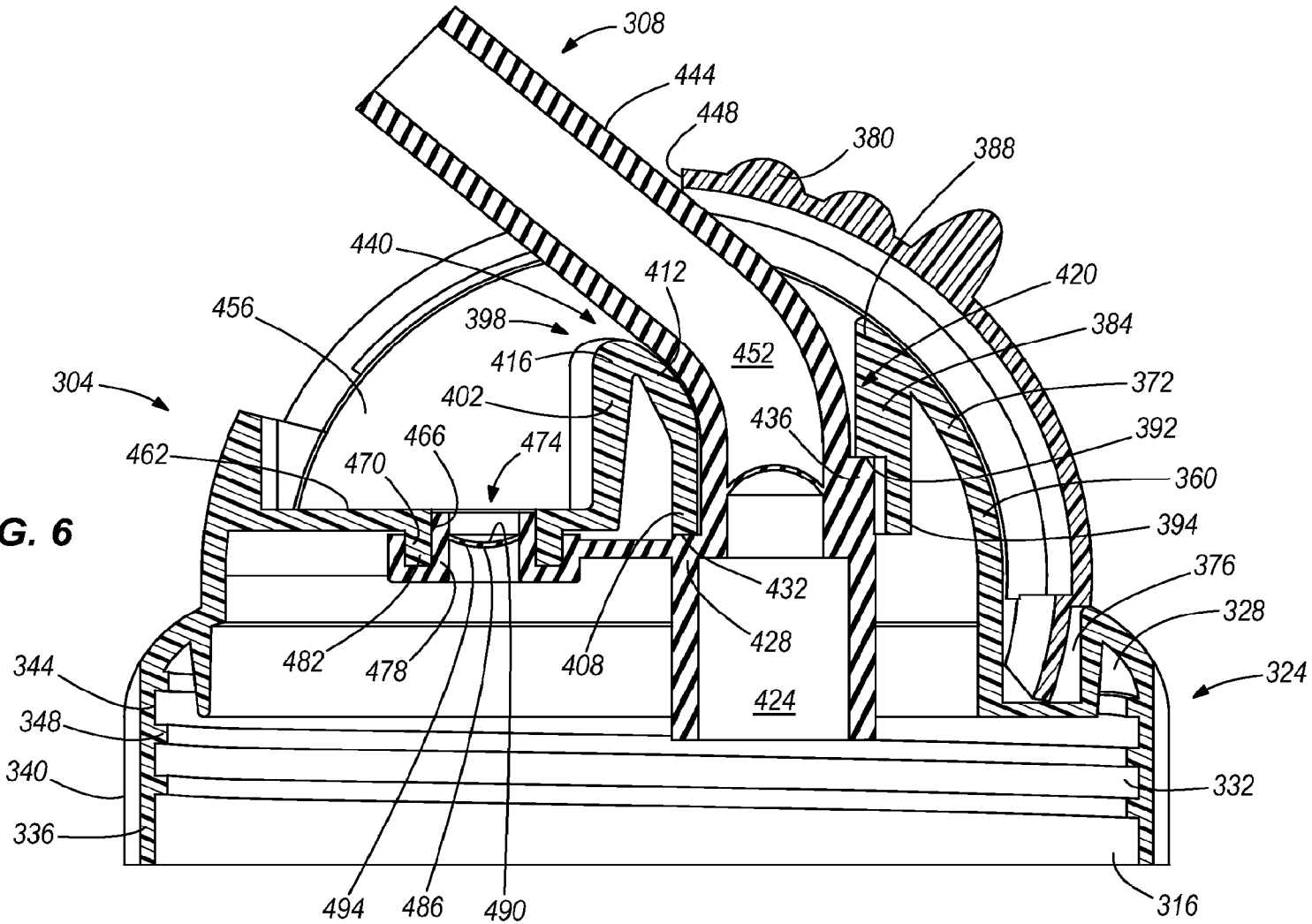
FIG. 6 is a side cross-sectional view of the drinking container illustrated in FIG. 4.
Figure 7:
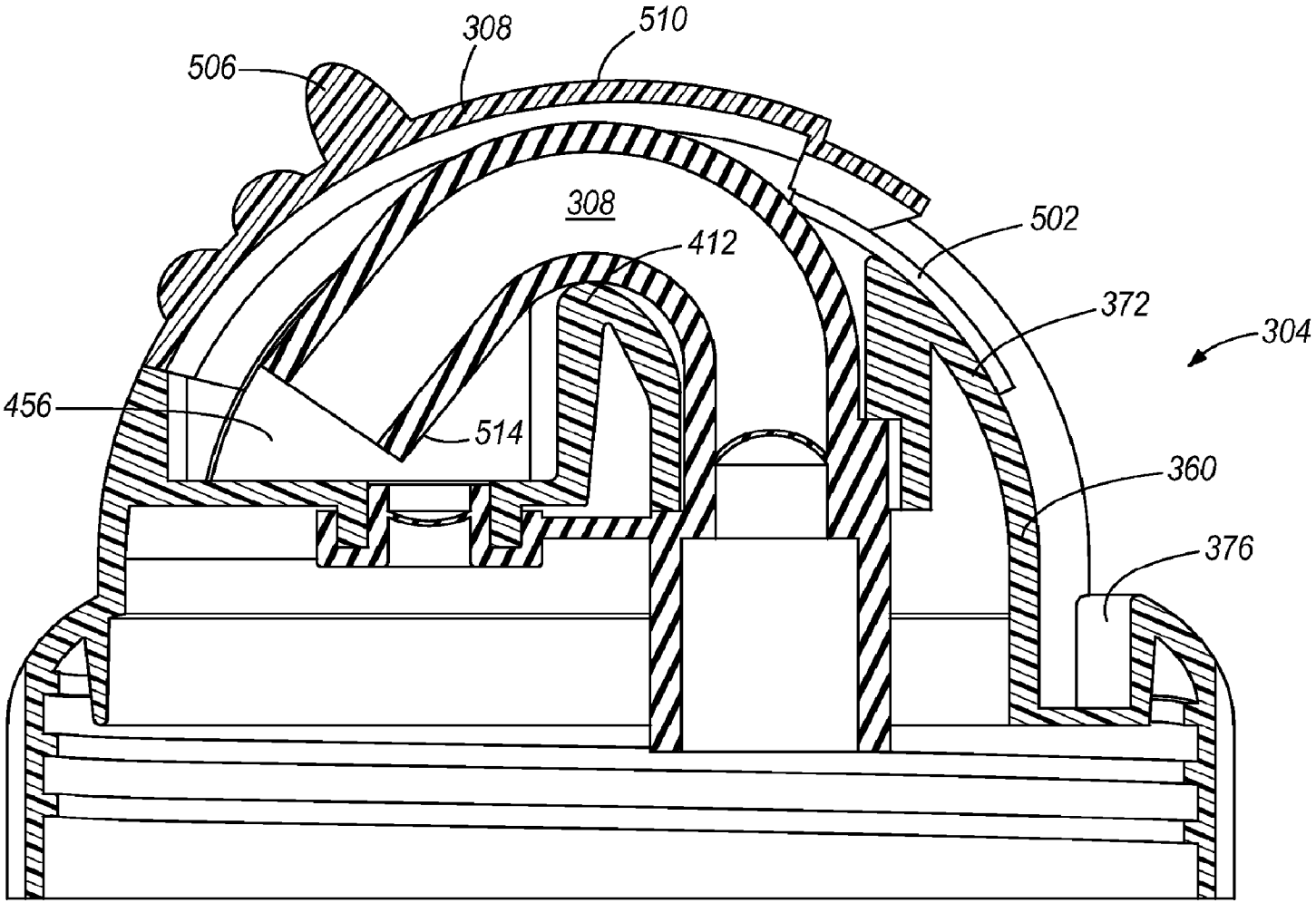
FIG. 7 is a side cross-sectional view of the drinking container illustrated in FIG. 4.

The lid 304 includes the cover 380 supported by the two planar walls 352, 356. The cover 380 is dome-shaped and includes a flange 498 on at least two of the parallel sides of cover 380. The flanges 498 engage a track 502 formed along the curvature of the planar walls 352, 356. The cover 380 includes a knob 506 on a top surface 510 that allows the user to manipulate the cover 380 between an open position (as shown in FIG. 6) and a closed position (as shown in FIG. 7).

When the cover 380 is in an open position, the upper portion 444 of the straw 308 extends outward from the lid 304 such that the user can drink from the straw 308. In the open position, cover 380 generally rests upon or is supported by the curved portion 372 of the third wall 360. At least a portion of the cover 380 is received within the recess 376.

When the cover 380 is moved from the open position toward the closed position, the cover 380 contacts the upper portion 444 of the straw 308 to urge the upper portion 444 of the straw 308 into the recess 456. The upper portion 444 of the straw 308 bends around the curved portion 412 of the protrusion 398 until a distal end 514 of the straw 308 is positioned within the recess 456. While the cover 380 is closed, the upper portion 444 of the straw 308 is enclosed within the lid 304. The straw 308 does not close or restrict fluid flow therein (i.e., the straw 308 does not pinch or kink shut). If fluid leaks out the distal end 514 of the straw 308, the excess fluid will collect in the recess 456 and flow back into the interior 320 of the container 300 through the membrane 486 in the vent 474.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A drinking container comprising:

a main body defining an interior cavity accessible through an opening at an upper end of the main body, the main body having a rim about the opening; and a removable lid secured to the rim of the main body to enclose the interior cavity, the removable lid including an outer wall, an inner support structure supported by the outer wall, the inner support structure having a first wall, a member extending from the first wall, a protrusion including a second wall positioned opposite the first wall, the second wall having a first portion substantially parallel with respect to the first wall and a curved portion extending upward from the first portion, and an opening between the member and the second wall;

a straw positioned in the opening and coupled to the inner support structure, the straw having a lower portion extending into the interior cavity of the main body and an upper portion extending through the opening; and a removable cover coupled to the removable lid, the cover including an opening configured to receive the upper portion of the straw and a slide mechanism configured to slide within the opening of the cover and bend the upper portion of the straw along the curved portion of the second wall and enclose the upper portion of the straw within the cover.

2. The drinking container as set forth in claim 1 wherein the straw does not restrict fluid flow when the slide mechanism is in a closed position.

3. The drinking container as set forth in claim 1 wherein the inner support structure further includes a recess adapted to receive the upper portion of the straw when the slide mechanism is in a closed position.

4. The drinking container as set forth in claim 3 wherein the recess includes a vent configured for air intake when suction is applied to the upper portion of the straw.

5. The drinking container as set forth in claim 4 wherein the recess is configured to receive fluid and the vent is configured to deliver the fluid to the interior cavity.

6. The drinking container as set forth in claim 4 wherein the vent includes a membrane having a concave outer surface and a convex inner surface.

7. The drinking container as set forth in claim 1 wherein the upper portion of the straw is configured to bend about 10 degrees to about 30 degrees.

8. The drinking container as set forth in claim 1 wherein the upper portion of the straw is configured to bend about 10 degrees to about 60 degrees.

9. The drinking container as set forth in claim 1 wherein the first wall includes a notch at a lower end and wherein the lower portion of the straw includes an extension adapted to engage the notch to prevent the straw from being removed through the opening.

10. A drinking container comprising:

a main body defining an interior cavity accessible through an opening at an upper end of the main body, the main body having a rim about the opening; and a removable lid secured to the rim of the main body to enclose the interior cavity, the removable lid including an outer wall having a first portion and a second portion, a cover coupled between the first portion and the second portion, the cover including an edge, a first wall, a curved wall extending from a peak of the first wall, the curved wall coupled to the outer wall and including a cavity, a protrusion including a second wall positioned opposite the first wall, the second wall having a first portion substantially parallel with respect to the first wall and a curved portion extending upward from the first portion, a first opening between the peak and the second wall, a second opening between the edge and the second wall; and a straw positioned in the first opening and coupled to first wall, the straw having a lower portion extending into the interior cavity of the main body and an upper portion extending through the first opening, wherein the cover is configured to slide between an open position and a closed position such that in the open position the upper portion of the straw extends through the second opening and in the closed position the edge bends the upper portion of the straw along the curved portion of the second wall to enclose the upper portion of the straw within the lid.

11. A drinking container as set forth in claim 10 wherein a portion of the cover is secured in the cavity when the cover is in the open position.

12. A drinking container as set forth in claim 10 wherein the peak of the first wall has a greater height than the second wall.

13. The drinking container as set forth in claim 10 wherein the straw does not restrict fluid flow when the cover is in a closed position.

14. The drinking container as set forth in claim 10 wherein the removable lid further includes a recess adapted to receive the upper portion of the straw when the cover is in a closed position.

15. The drinking container as set forth in claim 14 wherein the recess includes a vent configured for air intake when suction is applied to the upper portion of the straw.

16. The drinking container as set forth in claim 15 wherein the recess is configured to receive fluid and the vent is configured to deliver the fluid to the interior cavity.

17. The drinking container as set forth in claim 15 wherein the vent includes a membrane having a concave outer surface and a convex inner surface.

18. The drinking container as set forth in claim 10 wherein the upper portion of the straw is configured to bend about 10 degrees to about 30 degrees.

19. The drinking container as set forth in claim 10 wherein the upper portion of the straw is configured to bend about 10 degrees to about 60 degrees.

20. The drinking container as set forth in claim 10 wherein the first wall includes a notch at a lower end and wherein the lower portion of the straw includes an extension adapted to engage the notch to prevent the straw from being removed through the opening.

* * * * *